US008157336B2

(12) United States Patent
Hayase et al.

(10) Patent No.: US 8,157,336 B2
(45) Date of Patent: Apr. 17, 2012

(54) SHOWCASE

(75) Inventors: Koji Hayase, Ota (JP); Kazuo Tetsukawa, Isesaki (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 238 days.

(21) Appl. No.: 11/826,094

(22) Filed: Jul. 12, 2007

(65) Prior Publication Data

US 2008/0018209 A1 Jan. 24, 2008

(30) Foreign Application Priority Data

Jul. 19, 2006 (JP) ..... 2006-197215

(51) Int. Cl.
*E05C 7/06* (2006.01)

(52) U.S. Cl. ..... 312/222

(58) Field of Classification Search ..... 312/138.1, 312/215, 222, 109, 405, 326; 292/63, 66, 292/64, 65, 67, 68, 69
See application file for complete search history.

(56) References Cited

U.S. PATENT DOCUMENTS

| | | | | |
|---|---|---|---|---|
| 2,845,320 | A * | 7/1958 | Saunders et al. | 312/204 |
| 3,637,246 | A * | 1/1972 | Leiter | 292/87 |
| D244,019 | S * | 4/1977 | Brown | D15/88 |
| 4,132,440 | A * | 1/1979 | Johnson | 292/341.19 |
| 5,429,430 | A | 7/1995 | Johnson | 312/128 |
| 5,582,442 | A * | 12/1996 | Nolte | 292/101 |
| 6,006,558 | A * | 12/1999 | Peters | 70/63 |

FOREIGN PATENT DOCUMENTS

| | | |
|---|---|---|
| EP | 1 535 542 | 6/2005 |
| JP | 3-121016 | 5/1991 |
| JP | 2005152528 | 6/2005 |
| WO | WO 2005/044059 | 5/2005 |

OTHER PUBLICATIONS

Extended European Search Report dated Jan. 19, 2011 (7 pages).

* cited by examiner

*Primary Examiner* — James O Hansen
*Assistant Examiner* — Matthew Ing
(74) *Attorney, Agent, or Firm* — Kratz, Quintos & Hanson, LLP

(57) ABSTRACT

There is disclosed a showcase in which a width of a transparent door can be extended to substantially the whole width of a main body even in a case where a locking device is incorporated in a handle of a transparent door. A low-temperature showcase comprises the transparent door which is rotatably supported on the main body on one side so as to openably close an opening of the main body including a showroom, the handle disposed at an outer surface of this transparent door on an unsupported side, and a locking device disposed in this handle. The locking device has a keyhole, a rotary shaft which rotates concentrically with a key by a rotating operation of the key inserted into this keyhole and a hook which is attached to this rotary shaft so as to disengageably engage with the main body, and the keyhole is disposed at a side surface of the handle on a supported side of the transparent door.

4 Claims, 9 Drawing Sheets

SHOWCASE

BACKGROUND OF THE INVENTION

The present invention relates to a showcase including a locking device of a transparent door.

Heretofore, in this type of showcase, commodities such as beverages and foods are stored in a showroom and, for example, cold air is circulated through the showroom to lower a temperature. In consequence, while the commodities are cooled, the commodities are displayed. An opening of this showroom is openably closed with a rotatable transparent glass door. When a shop is closed, this door is locked to prevent robbery of the commodities (e.g., see Japanese Patent Application Laid-Open Nos. 3-121016 and 2005-152528).

However, in the conventional locking device of this type of showcase, a lock is used as a component which is separate from the door. Therefore, the door unavoidably opens slightly. Moreover, the lock hangs down. Therefore, there has been a limitation to a locking capability. There is a danger that the lock itself is lost when unused.

To solve the problem, a structure is developed in which a so-called cylinder lock is incorporated in a handle disposed on an unsupported side of the door. When a rotating operation of a key inserted into a keyhole is performed, a hook of this cylinder lock is engaged with a showcase main body to lock. However, heretofore the keyhole of the cylinder lock is directed to a front part of the door and attached to the door. Therefore, the hook is rotated by a rotary shaft of the cylinder lock extending in a front and rear direction. That is, since the hook is engaged with the main body from a lateral direction (externally from the opening), the door cannot be extended in excess of a width of the main body. Therefore, a width of the door becomes smaller than that of the main body, and there has been a limitation to visibility through the glass of the door.

SUMMARY OF THE INVENTION

The present invention has been developed to solve such a conventional technical problem, and an object is to provide a showcase in which a width of a transparent door can substantially be extended to the whole width of a main body in a case where a locking device is incorporated in a handle of the transparent door.

A showcase of a first invention is characterized by comprising: a transparent door which is rotatably supported on a main body on one side so as to openably close an opening of the main body including a showroom; a handle disposed at an outer surface of the transparent door on an unsupported side; and a locking device disposed in this handle. The locking device has a keyhole, a rotary shaft which rotates concentrically with a key by a rotating operation of the key inserted into the keyhole and a hook which is attached to the rotary shaft so as to disengageably engage with the main body, and the keyhole is disposed at a side surface of the handle on a supported side of the transparent door.

A showcase of a second invention is characterized in that, in the above invention, the transparent door comprises a transparent wall and a sash which holds this transparent wall, and the handle is disposed at an outer surface of a side of the sash on the unsupported side.

A showcase of a third invention is characterized in that, in the above inventions, the transparent door is vertically inverted and attached, and the locking device has a structure in which an attachment angle of the hook to the rotary shaft is regulated to absorb rotation allowance of the rotary shaft.

A showcase of a fourth invention is characterized in that, in the above inventions, the handle is constituted by vertically arranging a hand portion and the locking device.

According to the first invention, in the showcase comprising: the transparent door which is rotatably supported on the main body on one side so as to openably close the opening of the main body including the showroom; the handle disposed at the outer surface of the transparent door on the unsupported side; and the locking device disposed in this handle, the locking device has the keyhole, the rotary shaft which rotates concentrically with the key by the rotating operation of the key inserted into the keyhole and the hook which is attached to this rotary shaft so as to disengageably engage with the main body. The keyhole is disposed at the side surface of the handle on the supported side of the transparent door. Therefore, when the operation of inserting the key into the keyhole to rotate the rotary shaft is performed, the hook can engage with an opening end surface of the main body.

That is, the transparent door can be extended to substantially the whole width of the main body, and the hook can be engaged with the opening end surface of the main body. Therefore, when the transparent door includes the sash and the transparent wall as in the second invention, especially visibility of the inside of the showroom from the transparent wall can largely be improved. The key is inserted into the keyhole from the support side of the transparent door. Therefore, even when the side surface of the main body of the showcase on the unsupported side of the transparent door is installed so as to come in contact with a wall surface, the locking device can be locked/unlocked without any trouble.

Moreover, according to the third invention, in addition to the above inventions, the locking device has the structure in which the attachment angle of the hook to the rotary shaft is regulated to absorb the rotation allowance of the rotary shaft. Therefore, even in a case where the transparent door can vertically be inverted and attached, it is possible to eliminate a disadvantage that an engaged state between the hook and the main body during use of the door in the inverted state becomes defective owing to the rotation allowance of the rotary shaft.

Furthermore, according to the fourth invention, in addition to the above inventions, the handle is constituted by vertically arranging the hand portion and the locking device. Therefore, in a case where the hand portion of the handle is held with fingers to open or close the transparent door, the locking device does not hinder the opening or closing operation.

DETAILED DESCRIPTION OF THE PREFERRED EMBODIMENT

Figure 1:
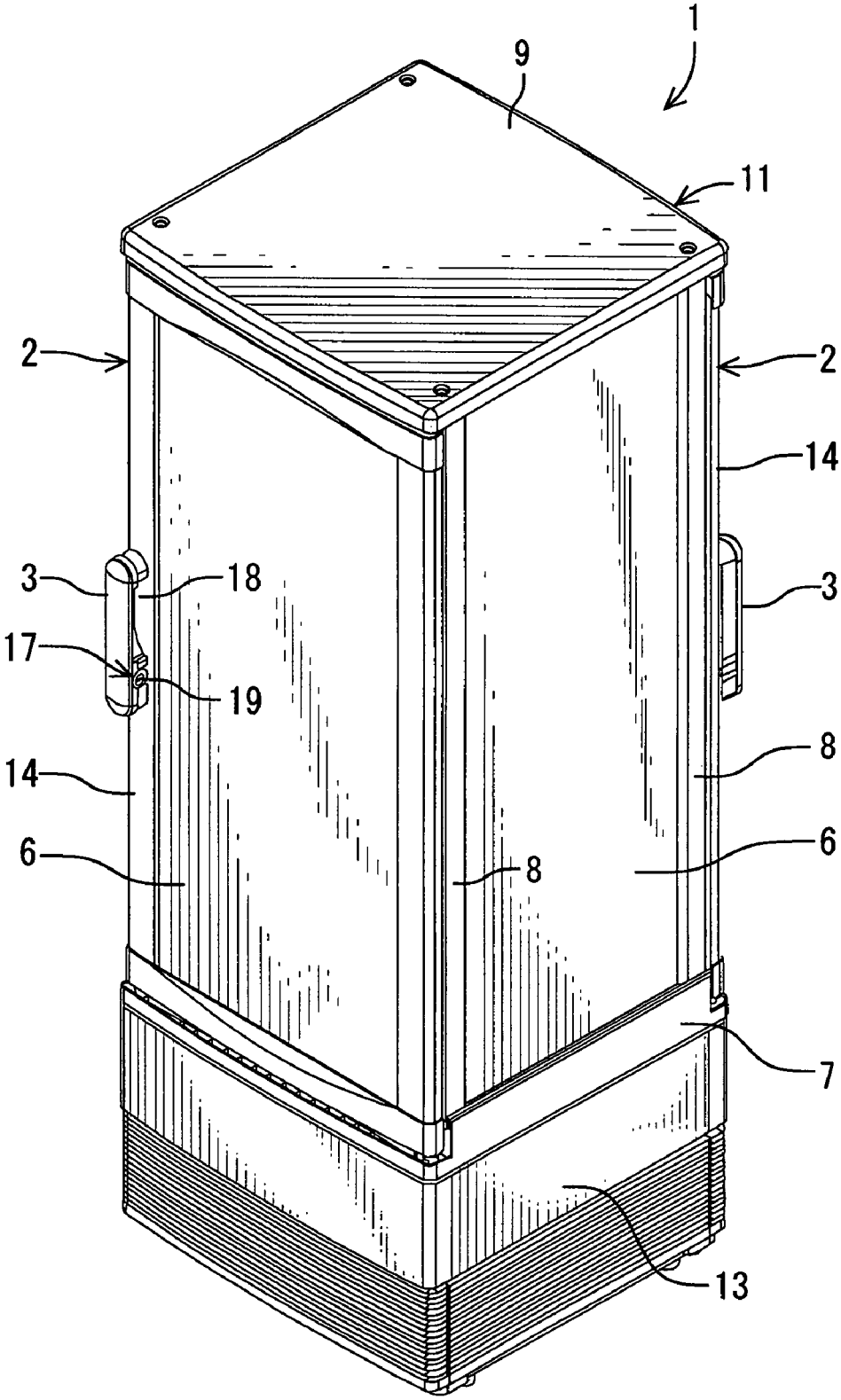
FIG. 1 is a perspective view of a low-temperature showcase as an embodiment of a showcase to which the present invention is applied.

Embodiments of the present invention will hereinafter be described with reference to the drawings.

Embodiment 1

A low-temperature showcase 1 of this embodiment is a so-called desk-top showcase in which four surrounding surfaces of a showroom 4 are surrounded with transparent walls 6 . . . made of double transparent glass. An insulating wall 7, supports 8 . . . vertically disposed at four corners of this insulating wall 7, a top plate 9 and the transparent walls 6, 6 of left and right surfaces held by these insulating wall 7, supports 8 and top plate 9 and the like constitute a main body 11. A bottom plate 12 also made of a hard synthetic resin is attached to an upper surface of the insulating wall 7 disposed inwardly from the transparent walls 6, 6 of the left and right surfaces, and the showroom 4 is constituted in the main body 11 defined by these bottom plate 12, top plate 9 and left and right transparent walls 6, 6.

According to such a constitution, a front surface and a rear surface of a showroom 4 part of the main body 11 are opened. Moreover, the front and rear openings are openably closed by two transparent doors 2, 2. It is to be noted that the same door is used in the front and rear transparent doors 2, 2. Upper and lower portions of the front and rear transparent doors 2, 2 on the right as one faces are rotatably supported by and attached to the top plate 9 and the bottom frame 7 of the main body 11. The transparent doors 2 include peripheral sashes 14 made of a hard synthetic resin, and the transparent walls 6 made of double transparent glass and held inwardly from the sashes 14. A handle 3 is attached to one side of an outer surface (a front surface) on an unsupported side, that is, substantially the center of the outer surface (the front surface) of a left side (a side on the unsupported side of each transparent door 2) of the sash 14 as one faces. It is to be noted that G is a magnet gasket attached to a periphery of an inner surface of the sash 14. When the transparent door 2 is closed, the gasket is adsorbed by an angle 8A disposed in the support 8 and made of a steel plate constituting the support 8.

Moreover, a mechanical chamber 13 is constituted under the insulating wall 7 and positioned under the showroom 4. In this mechanical chamber 13, a compressor and a condenser (not shown) which constitute a refrigerant circuit of a cooling unit are arranged, and a fan for the condenser is installed in order to cool the compressor and the condenser with air. Moreover, a cooling chamber (not shown) is constituted in the insulating wall 7. In this cooling chamber, an evaporator (not shown) constituting the refrigerant circuit of the cooling unit together with the compressor and the like, and a fan for cooling are stored. A bottom plate 12 is provided with a cold air suction port and a cold air discharge port (not shown) positioned at a bottom part of the showroom 4, and the ports communicate with the cooling chamber of the insulating wall 7. It is to be noted that reference numerals 16 are mesh racks arranged in the showroom 4.

When the compressor is operated, the evaporator performs a cooling function. Cold air of the cooling chamber cooled by heat exchange performed between the evaporator and the cooling chamber is sucked by the fan for cooling, and discharged upwards from the cold air discharge port into the showroom 4. The cold air discharged into the showroom 4 flows upwards and is circulated through the showroom 4 to cool the commodities on the racks 16 and the like. Subsequently, the air flows downwards to return from the cold air suction port into the cooling chamber. In consequence, the inside of the showroom 4 is cooled at a predetermined temperature (usually a refrigeration temperature of +5° C. to +10° C.).

Next, the transparent doors 2 and the handles 3 will be described in detail. It is to be noted that, as the transparent doors 2 of the embodiment, the same door is vertically inverted and used. In consequence, it is constituted that a case where the right of the door as one faces is supported as in the embodiment and a case where the left of the door is supported can be selected.

Figure 6:
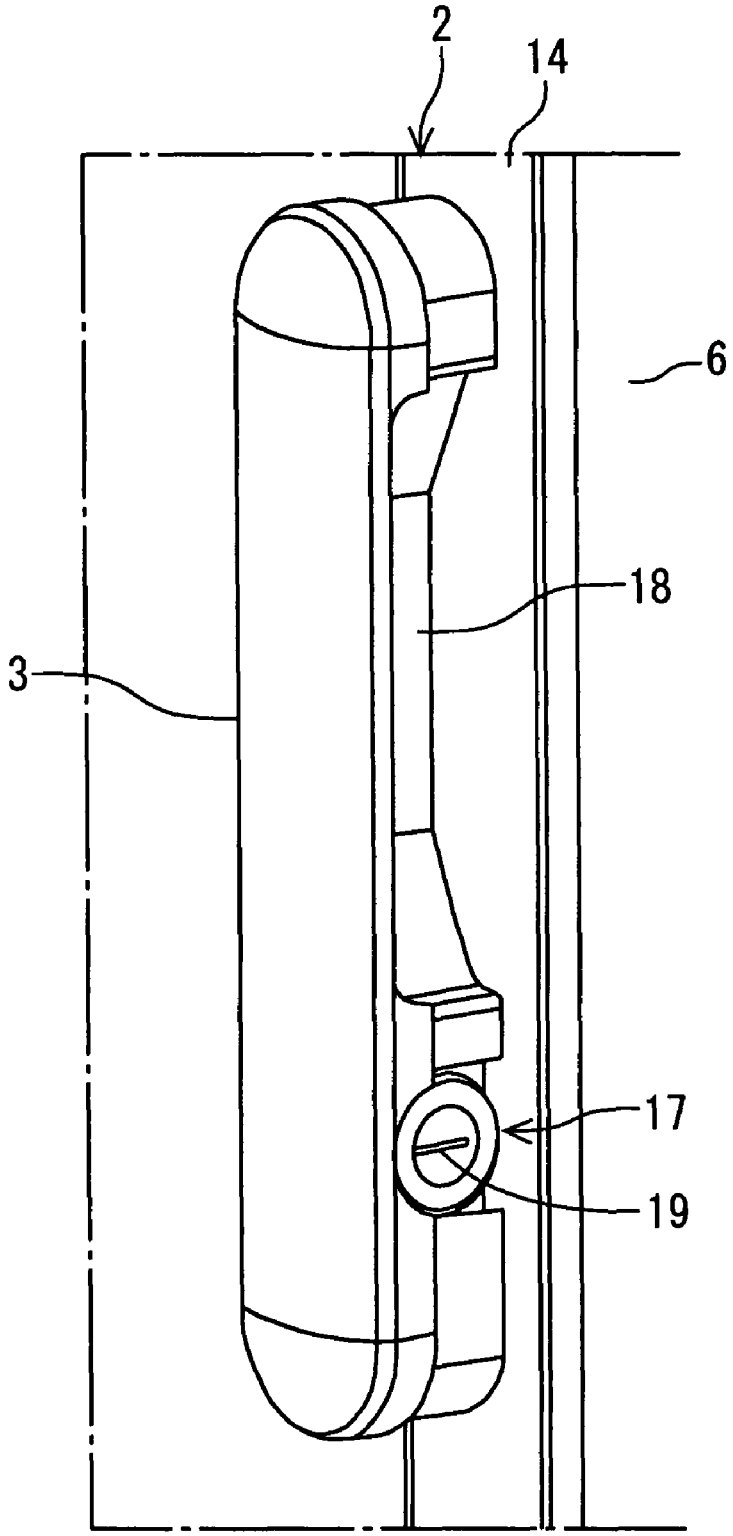
FIG. 6 is an enlarged perspective view of a handle of the transparent door of the low-temperature showcase of FIG. 1 as viewed from a transparent door supported side.
Figure 7:
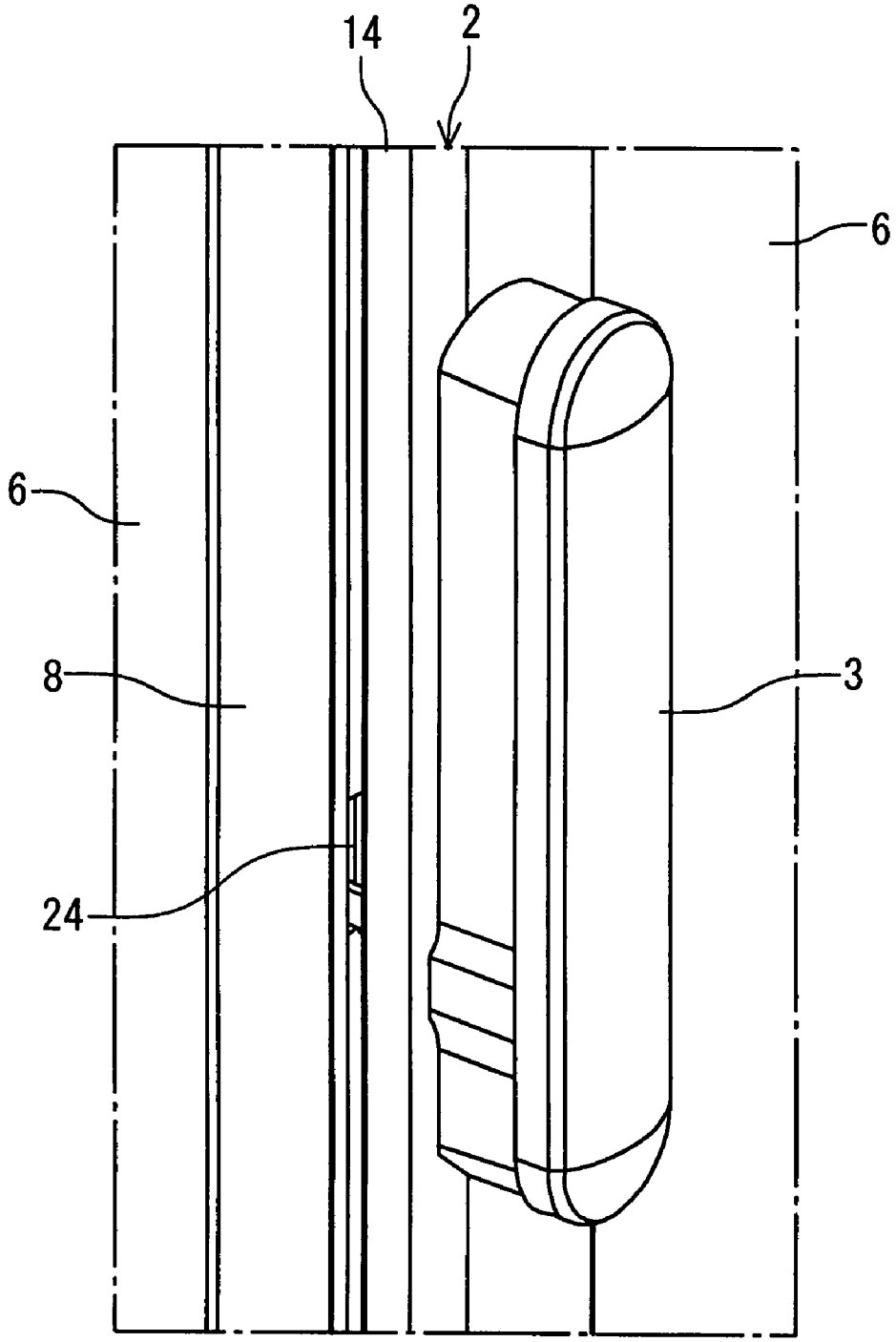
FIG. 7 is an enlarged perspective view of the handle of the transparent door of the low-temperature showcase of FIG. 1 as viewed from a transparent door unsupported side.

As shown in FIGS. 6, 7, the handle 3 has predetermined vertical, width and depth dimensions so that the handle can be operated with fingers. A locking device 17 is attached to an inner portion of the handle. A hand portion 18 is formed to be recessed in a vertical direction at an upper portion of a side surface of the handle 3 directed toward the outer surface (the front surface) of the transparent door 2, that is, the side surface of the handle 3 facing a supported side of the transparent door 2. At the side surface of a portion of the handle under the hand portion 18 (a lower portion of the handle 3 which faces the supported side of the transparent door 2), a keyhole 19 of the locking device 17 is arranged so as to be exposed.

That is, in FIGS. 6 and 7, the hand portion 18 and the locking device 17 are vertically separately disposed when positioned in the handle 3. To open and close the transparent door 2, the hand portion 18 is held with the fingers to perform an operation. Since the locking device 17 is positioned under the hand portion, the opening and closing operation is not hindered by the locking device. This also applies to a case where the transparent door 2 is vertically inverted for use. In this case, the locking device 17 is disposed above the hand portion, and the hand portion 18 is disposed under the locking device.

Figure 4:
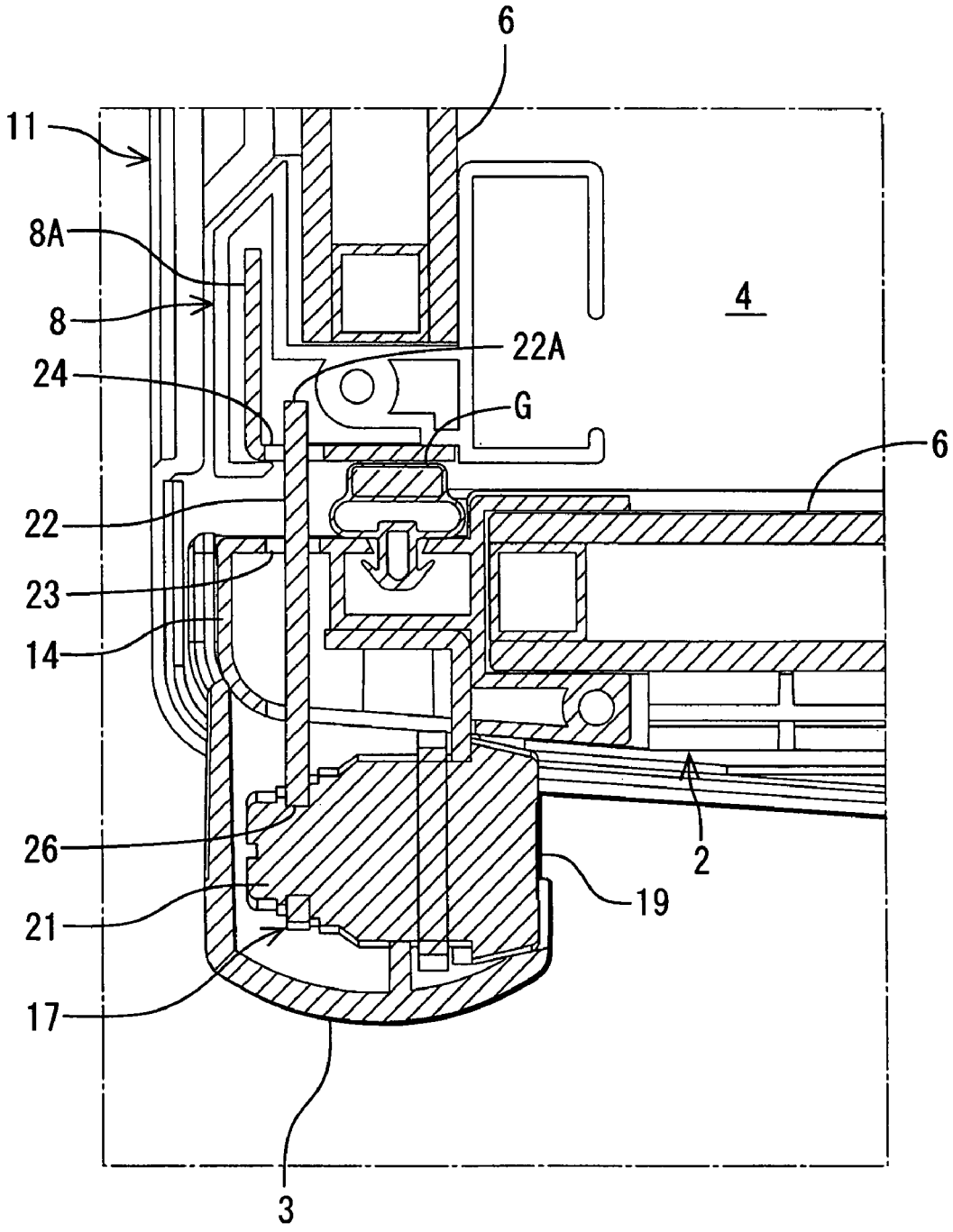
FIG. 4 is a sectional plan view showing a handle portion of a transparent door of the low-temperature showcase of FIG. 1.

That is, the handle 3 is positioned on the unsupported side of the transparent door 2 (on the left as one faces in the embodiment). As shown in FIGS. 1, 4 and 6, the keyhole 19 is directed and exposed toward a space at the outer surface (the front surface) of the transparent door 2 on the supported side of the transparent door 2 (on the right as one faces in the embodiment).

Figure 5:
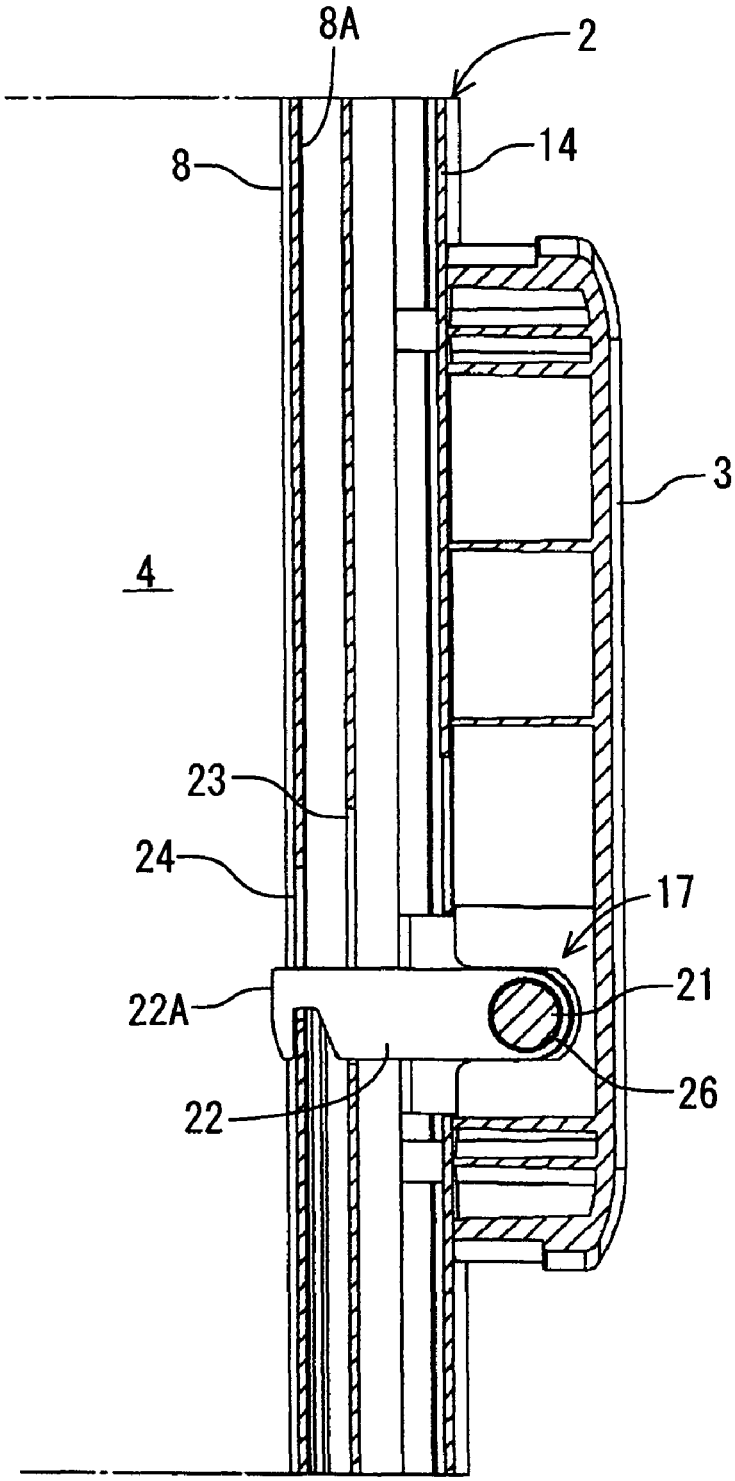
FIG. 5 is a vertical side view showing the handle portion of the transparent door of the low-temperature showcase of FIG. 1.

As shown in FIGS. 4 and 5, this locking device 17 includes a rotary shaft 21, and one end surface of this rotary shaft 21 is provided with the keyhole 19. That is, the rotary shaft 21 is horizontally disposed in parallel with a line extending from the supported side to the unsupported side of the transparent door 2, and the key and the rotary shaft 21 concentrically rotate by the rotating operation of the key (not shown) inserted into the keyhole 19.

A hook 22 is attached to the other end portion of this rotary shaft 21. In this case, a fitting hole 26 is formed at a base portion of the hook 22. This fitting hole 26 is fitted into the rotary shaft 21, when the hook is attached. This hook 22 is attached in a direction crossing the rotary shaft 21 at right angles. The hook protrudes toward the main body 11 from a through hole 23 formed at an inner surface of the sash 14 outside the gasket G so that the hook is directed from the handle 3 toward the support 8 in a state in which the transparent door 2 is closed. A tip end portion of the hook 22 is provided with a hook portion 22A. It is to be noted that, in a case where the transparent door 2 is supported on the right as one faces as in the embodiment, this hook portion 22A is directed downwards (FIG. 5).

On the other hand, as shown in FIGS. 1 and 4, a width of the sash 14 of the transparent door 2 is extended to be substantially equal to the whole width of the main body 11. Therefore, in the state in which the transparent door 2 is closed, the gasket G is adsorbed by the angle 8A positioned at a front surface of the support 8 constituting an opening end surface of the main body 11 (a rear surface of the support 8 constituting a rear-surface opening). In consequence, a width of the transparent wall 6 of the transparent door 2 is extended to a dimension corresponding to a space between the left and right transparent walls 6 and 6, that is, a width of the showroom 4. Therefore, substantially the whole inner region of the showroom 4 can visually be recognized through the transparent wall 6 of the transparent door 2 even from the front.

Figure 2:
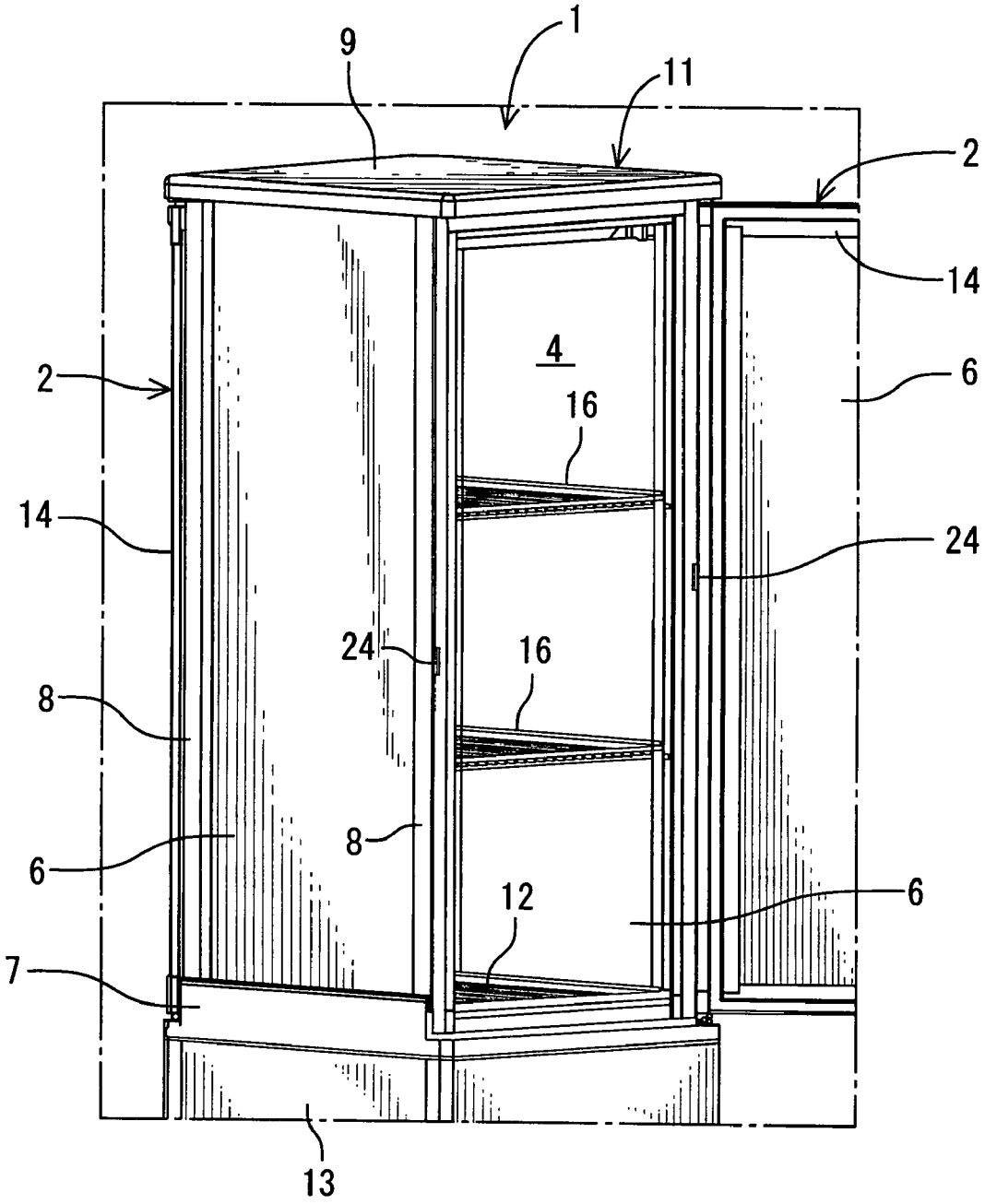
FIG. 2 is a perspective view of a state in which a transparent door of the low-temperature showcase of FIG. 1 is opened.
Figure 3:
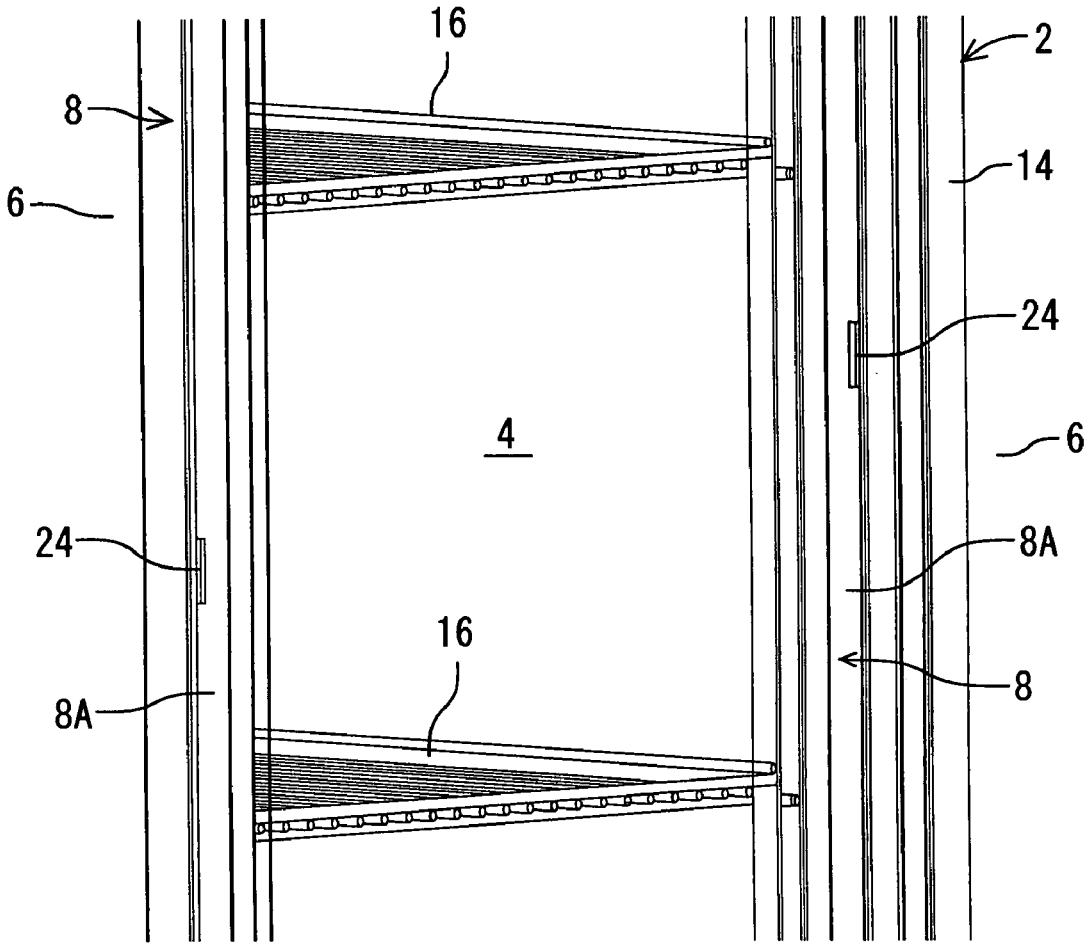
FIG. 3 is an enlarged view of FIG. 2.

Moreover, the angles 8A positioned at the front surfaces of the left and right supports 8, 8 constituting the opening end surface of the main body 11 are provided with slit-like engagement holes 24, 24. Each engagement hole 24 is formed outside a position where the gasket G is adsorbed, and the left engagement hole 24 as one faces is set at a height corresponding to that of a position of the locking device 17 of the transparent door 2. Here, in a case where the transparent door 2 is vertically inverted and attached, that is, in a case where the left of the door as one faces is supported, unlike the embodiment in which the right of the door as one faces is supported, the right engagement hole 24 as one faces is positioned so that the hook 22 of the locking device 17 engages with the engagement hole. The locking device 17 is positioned at the lower portion of the handle 3 as described above. Therefore, when the transparent door 2 is vertically inverted and attached, the locking device 17 is disposed above the hand portion 18. Therefore, since the position of the locking device 17 is raised, the right engagement hole 24 as one faces is positioned to be higher than the left engagement hole 24 as one faces (FIGS. 2, 3).

Furthermore, when the transparent door 2 is not locked, in FIG. 5, the hook 22 is raised in a vertical direction, and stored in the handle 3. When the transparent door 2 is closed and locked, a key is inserted into the keyhole 19 from the outside (a front side) of the transparent door 2 on the supported side of the transparent door 2 as viewed from the handle 3, and rotated counterclockwise in FIG. 5. Since the rotary shaft 21 rotates concentrically with the rotation of this key, the hook 22 rotates counterclockwise in FIG. 5, and the hook portion 22A of a tip end of the hook passes through the through hole 23 to disengageably engage with the engagement hole 24 of the angle 8A of the support 8 from above. In this case, since the engagement hole 24 is disposed outside the gasket G, as shown in FIG. 7, the engagement hole 24 can be seen from a gap (the gap corresponding to a dimension of the gasket G) between the main body 11 and the transparent door 2, and an engaged state between the hook 22 and the engagement hole 24 can be confirmed from the outside.

To unlock the door, the key is rotated in reverse. In consequence, since the hook 22 rotates clockwise in FIG. 5, the hook is disengaged from the engagement hole 24 and stored again in the handle 3. In this manner, the locking device 17 is disposed in the handle 3, and the keyhole 19 of the device is disposed at the side surface of the handle 3 on the supported side of the transparent door 2. When an operation of inserting the key into the keyhole 19 to rotate the rotary shaft 21, the hook 22 can engage with the opening end surface of the main body 11. Therefore, as described above, the transparent door 2 can be extended to substantially the whole width of the main body 11, and the hook 22 can be engaged with the opening end surface of the main body 11. Therefore, in the transparent door 2 including the sash 14 and the transparent wall 6 as in the embodiment, especially the visibility of the showroom 4 from the transparent wall 6 can largely be improved.

Moreover, the key is inserted into the keyhole 19 from the supported side of the transparent door 2. Therefore, even when the side surface (the left side surface viewed from the front surface) of the main body 11 on the unsupported side of the transparent door 2 is installed so as to come in contact with a wall surface of a place where the showcase is installed, the locking device 17 can be locked/unlocked without any trouble.

Embodiment 2

Here, when a transparent door 2 is vertically inverted and attached, that is, when the door is attached to a main body 11 so as to rotatably support the left of the door instead of supporting the right as one faces as in the embodiment, a locking device 17 is also vertically inverted. Therefore, in this case, a hook portion 22A of a hook 22 is directed upwards, and engages with an engagement hole 24 (on the right side of the opening of the main body 11 as one faces) from below.

On the other hand, a rotary shaft 21 of this type of locking device 17 is provided with allowance, and the rotary shaft 21 and the hook 22 freely rotates as much as a predetermined angle. In a case where the hook 22 engages with the engagement hole 24 from above as shown in FIG. 5, this allowance functions so as to rotate the rotary shaft 21 counterclockwise in FIG. 5 owing a weight of the hook 22, that is, rotate the hook 22 in such a direction as to engage with the engagement hole 24. However, when the transparent door 2 is vertically inverted, owing to the allowance of the rotary shaft 21, the hook 22 rotates in a direction away from the engagement hole 24 by use of its own weight, that is, in a direction in which the hook portion 22A is pulled down from the engagement hole 24 to release the engagement between the hook portion and the engagement hole. In consequence, in a case where the transparent door 2 is vertically inverted and attached, the engagement between the hook 22 and the engagement hole 24 becomes defective.

Figure 8:
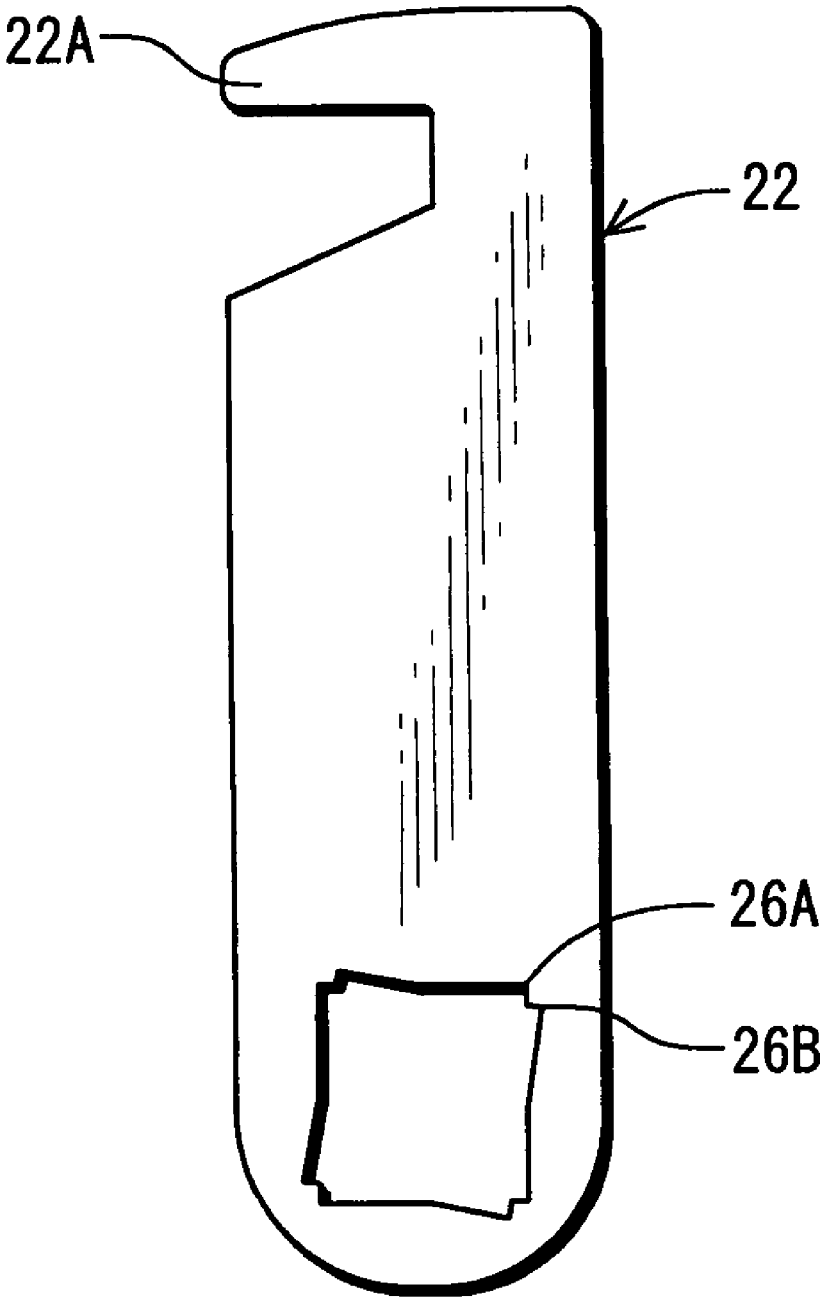
FIG. 8 is a front view showing a hook of a locking device according to another embodiment of the low-temperature showcase of FIG. 1.
Figure 9:
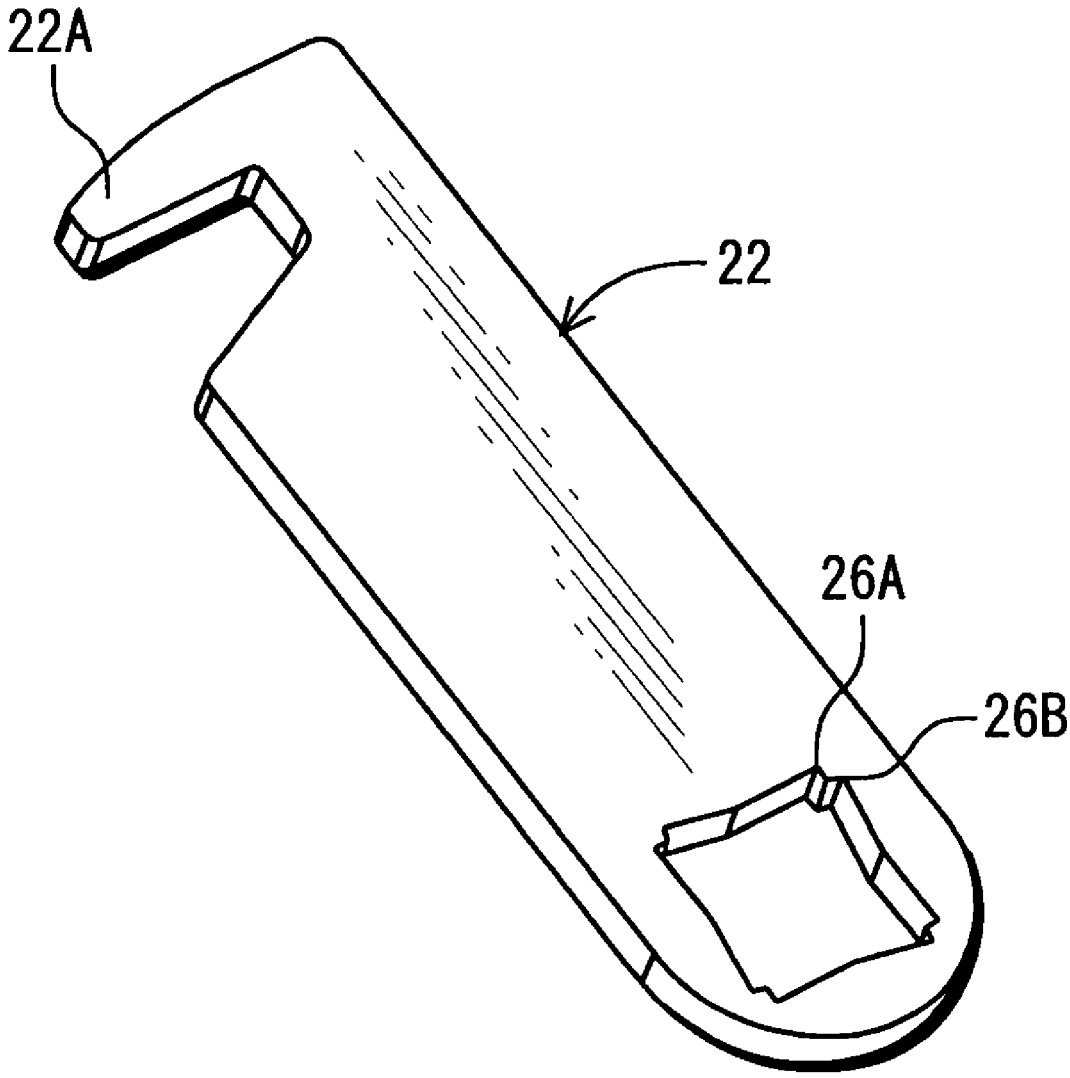
FIG. 9 is a perspective view showing the hook of the locking device of FIG. 8.

FIGS. 8 and 9 shows the hook 22 of the embodiment which eliminates such a disadvantage. In this case, a fitting hole 26 of the hook 22 is formed into a square hole, and constituted by combining two types of fitting holes 26A, 26B which deviate from each other at a predetermined angle (corresponding to an angle at which the rotary shaft 21 rotates owing to the allowance as described above). The other end portion of the rotary shaft 21 is also formed into a square sectional view, so that one of the fitting holes 26A, 26B of the hook 22 can selectively be fitted into the rotary shaft.

In the embodiment, sides of the fitting hole 26A extending toward the hook portion 22A are formed in parallel with an axis of the hook 22 in a longitudinal direction. The center of the fitting hole 26B is the same as that of the fitting hole 26A, and the fitting hole 26B is formed in a state in which the hole turns (deviates) at a predetermined angle from a tip end of the hook portion 22A to a base portion of the hook portion.

Moreover, as shown in FIG. 5, the transparent door 2 on the right side as one faces is supported, and the hook portion 22A of the hook 22 is directed downwards. In such an attached state, the fitting hole 26A is fitted into the rotary shaft 21. In this case, the rotation allowance of the rotary shaft 21 of the locking device 17 is provided so as to function so that the hook 22 is further rotated at a predetermined angle counterclockwise in FIG. 5 in a state in which the hook 22 engages with the engagement hole 24 and is substantially horizontally disposed. In consequence, an engaged state between the hook 22 and the engagement hole 24 is steadily maintained.

Subsequently, when the transparent door 2 provided with such a locking device 17 is vertically inverted and attached to the main body 11, the fitting hole 26B of the hook 22 is fitted into the rotary shaft 21 and attached to the shaft. In a case where the fitting hole 26B is fitted in this manner, as compared with a case where the fitting hole 26A is fitted, an attaching angle of the hook 22 is changed to such a state that the hook portion 22A of the hook 22 moves at a predetermined angle toward a tip end of the hook and is attached to the rotary shaft 21. Therefore, in a state in which the hook portion 22A of the hook 22 is pulled from the engagement hole 24 owing to the rotation allowance of the rotary shaft 21 during this rotation and attachment as described above, the allowance is absorbed, and the hook 22 is substantially horizontally disposed. In consequence, even in the state in which the door is vertically inverted and attached, disadvantages that the engaged state between the hook 22 and the engagement hole 24 is loosened owing to the rotation allowance of the rotary shaft 21 and that the hook disengaged from the engagement hole owing to an engagement defect are eliminated.

It is to be noted that, in the embodiment, the present invention is applied to a low-temperature showcase in which the four surrounding surfaces of a showroom 4 are surrounded with transparent walls 6 and in which front and rear openings are openably closed with the transparent doors 2, 2. The present invention is not limited to the embodiment, and the present invention is effective even for a showcase in which an only front surface is openably closed with the transparent door 2.

What is claimed is:

1. A showcase comprising:

a main body having an opening with an opening end surface;

a transparent door which is rotatably supported on the main body on one side of the opening so as to openably close the opening of the main body including a showroom;

a handle disposed at an outer surface of the transparent door on an unsupported side of the transparent door; and a locking device disposed in the handle, wherein the locking device has a keyhole, a rotary shaft horizontally disposed in parallel with a line extending from the supported side to the unsupported side of the transparent door and having the keyhole in one end surface thereof, which rotates concentrically with a key by a rotating operation of the key inserted into the keyhole and a hook which is attached to the rotary shaft in a direction crossing the rotary shaft at right angles, so as to protrude toward the main body and disengageably engage with the opening end surface of the main body in the state in which the transparent door is closed and the rotary shaft rotated by the key, and the keyhole is disposed so as to have the key inserted from a side surface of the handle, the side surface being that facing toward the supported side of the transparent door; wherein the transparent door is vertically inverted and attached, and the locking device includes a hook mounted to the rotary shaft, said hook extending through a first fitting hole in said handle, a second fitting hole in a front surface of said door, a third fitting hole a rear surface of said door, and a fourth fitting hole in said main body; wherein said first fitting hole is larger than said second fitting hole, said second fitting hole is larger than said third fitting hole, and said third fitting hole is larger than said fourth fitting hole; and wherein said hook rotatably moves through said first, second, third, and fourth fitting holes when the shaft is rotated.

2. The showcase according to claim 1, wherein the transparent door comprises a transparent wall and a sash which holds the transparent wall, and the handle is disposed at an outer surface of a side of the sash on the unsupported side.

3. The showcase according to claim 1, wherein the handle is constituted by vertically arranging a hand portion and the locking device.

4. The showcase according to claim 2, wherein the handle is constituted by vertically arranging a hand portion and the locking device.

* * * * *